United States Patent [19]

Pinto

[11] 4,057,039

[45] Nov. 8, 1977

[54] ENGINE HAVING ALTERNATELY ROTATING ORBITAL PISTONS AND CYLINDERS

[76] Inventor: Adolf P. Pinto, 1807 Hunt Ave., Richland, Wash. 99352

[21] Appl. No.: 684,156

[22] Filed: May 7, 1976

[51] Int. Cl.[2] ..... F02B 57/00

[52] U.S. Cl. ..... 123/43 B

[58] Field of Search ..... 123/43 B, 43 R, 18 A; 91/210

[56] References Cited

U.S. PATENT DOCUMENTS

| | | | |
|---|---|---|---|
| 1,344,158 | 6/1920 | Walk | 123/43 B |
| 1,349,054 | 8/1920 | Fischer | 123/43 B |
| 1,823,132 | 9/1931 | Cunningham | 123/43 B |
| 2,170,213 | 8/1939 | Prew | 123/43 B |

*Primary Examiner*—Clarence R. Gordon
*Attorney, Agent, or Firm*—Chernoff & Vilhauer

[57] ABSTRACT

An engine having valve means, timing means, fuel distribution means and ignition means configured for operation on a combustible mixture of fuel and air, or other energy source, comprises at least one annular cylinder and mating annular piston forming combustion chambers at both ends and configured for orbital rotation about a central crank. Escapement means transfers orbital rotation of the piston and cylinder in a first direction to the crank and prevents their rotation in the opposite direction relative to the grounded frame which encloses the engine. The piston and cylinder alternately are rotated in the first direction by expansion or contraction of the energy source in successively predetermined combustion chambers on each stroke to rotate the crank.

8 Claims, 13 Drawing Figures

ENGINE HAVING ALTERNATELY ROTATING ORBITAL PISTONS AND CYLINDERS

BACKGROUND OF THE INVENTION

This invention relates in general to an engine, and in particular to such an engine having an orbital piston and mating cylinder which alternately transmit energy to a central crank.

With the steadily decreasing availability of energy sources, particularly liquid hydrocarbon fuels such as gasoline, it has become increasingly desirable to develop small, low powered, low speed internal combustion engines which are efficient. Rotary engines have been used frequently in the past for this purpose since maximum torque is delivered to the crank during the entire firing portion of their operation cycle. Rotary engines have been used as a replacement for reciprocating internal combustion engines, which, due to the eccentric connection of the connecting rod to the crank, provide low torque at the initiation of the stroke when the crank presents little lever arm to the connecting rod.

The prior art rotary engines generally combine an irregularly shaped rotor rotatably enclosed in a mating housing which defines several isolated combustion chambers. Since these rotors are of the continuous rotation type, they are difficult to seal against loss of combustion gases, thus causing excess emissions of unburned hydrocarbons. In addition the seals are subject to unsymmetrical loading causing rapid wear necessitating frequent, expensive replacement.

Accordingly, it is the general purpose of the present invention to provide a rotary engine utilizing an arcuate cylinder and an enclosed sealed piston which alternately move in a common direction around a central crank transmitting force to the crank through a lever arm having a length which is independent of piston displacement, by means of connecting rods which remain normal to the applied force at all times.

It is a further purpose of the present invention to provide such an engine having simple, low cost valve means and valve timing means configured for positive operation.

It is a further purpose of the present invention to provide a positive escapement means in such an engine imparting rotary movement of the piston and cylinder in a first direction to a central crank and preventing their movement in the opposite direction.

THE DRAWINGS

The manner in which the foregoing and other objects of the invention are accomplished will be apparent from the accompanying specification and claims, considered together with the drawings wherein:

Figure 12:
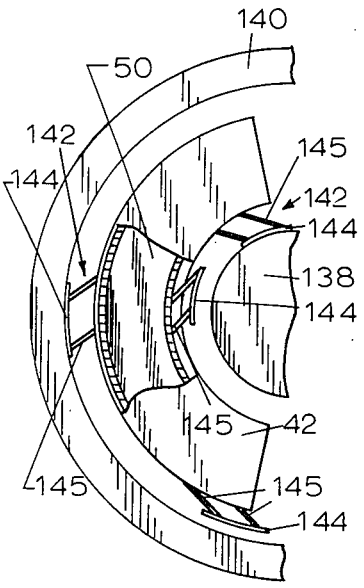
Figure 13:
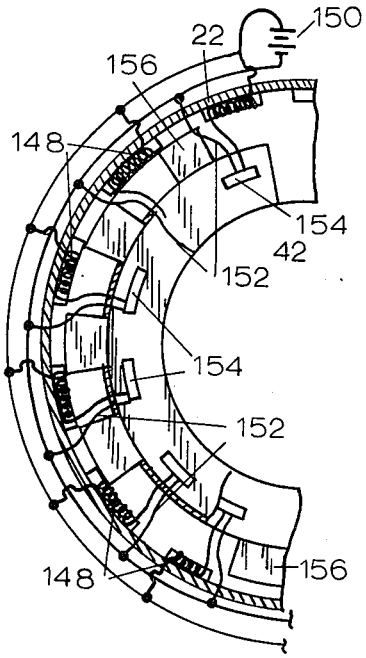

FIGS. 8—11 are diagrammatic plan views of the operative elements of the engine showing its sequence of operation;

FIG. 12 is a diagrammatic, fragmentary plan view showing another embodiment of the escapement means which is an element of the invention; and FIG. 13 is a diagrammatic, fragmentary plan view of another embodiment of the escapement means of the invention.

GENERAL STATEMENT OF THE INVENTION

The engine of the present invention broadly comprises at least one annular cylinder and a mating piston configured for reciprocal movement therein forming combustion chambers at both ends of the cylinder and both configured for orbital rotation about a central crank.

Escapement means transfers orbital movement of the piston and cylinder in a first direction to the crank and prevents rotation of them in the opposite direction relative to a grounded frame which encloses the engine.

In the embodiment illustrated the engine includes valve means, valve timing means, fuel distribution means and ignition means configured for four-stroke cycle operation of the engine on a combustible mixture of air and fuel.

DETAILED DESCRIPTION OF PREFERRED EMBODIMENTS

Figure 1:
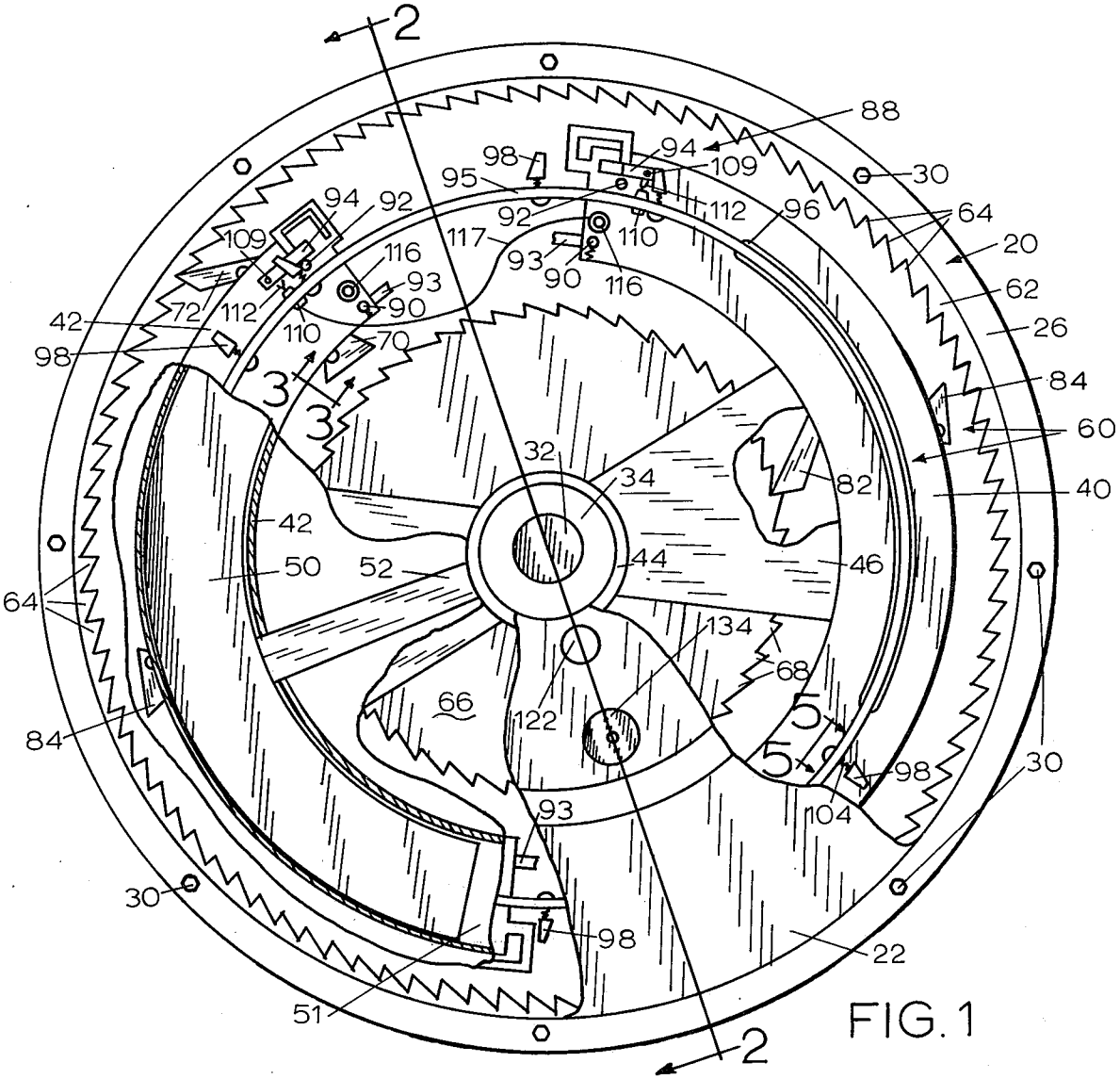
FIG. 1 is a plan view of the herein described engine, partially broken away to show concealed construction.
Figure 2:
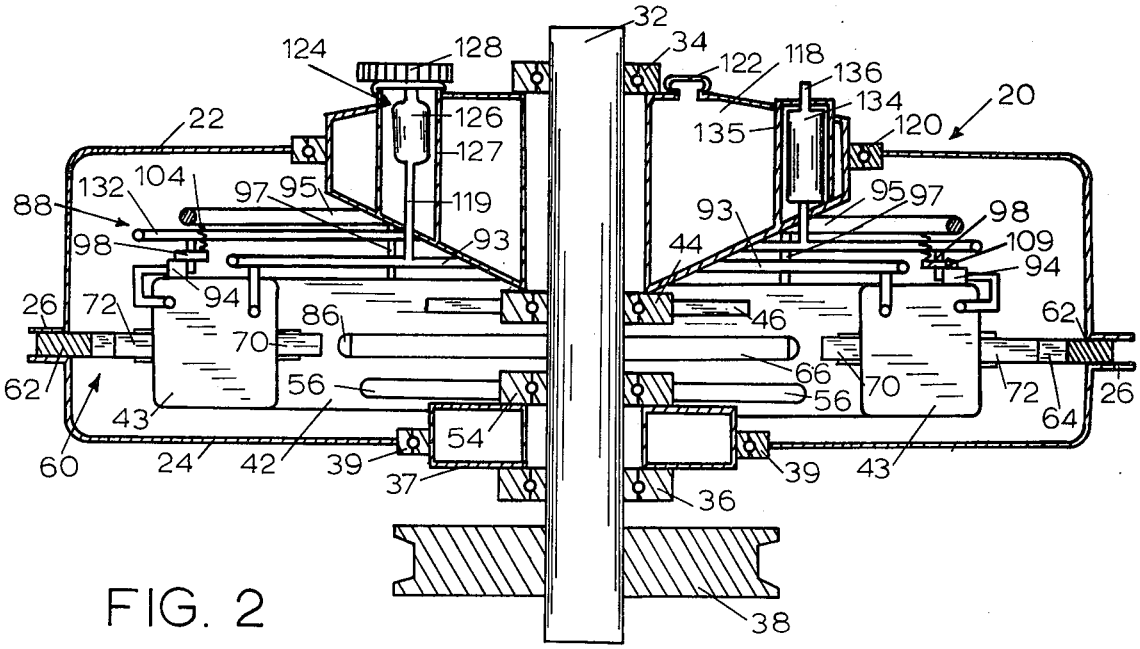
FIG. 2 is a cross sectional view in side elevation taken on line 2—2 of FIG. 1.

Referring to FIGS. 1 and 2 of the drawings, the engine of the present invention includes a frame 20 which supports and encloses the operative elements of the engine. The frame includes an upper portion 22 and a lower portion 24, each comprising a cylindrical side wall with an integrally joined flat circular end. Outwardly facing mating annular flanges 26 attached to the inner ends of the side walls contain spaced bolt holes. Bolts 30 pass through the holes to join the frame portions together thus forming an enclosed cavity. In the embodiment illustrated the side wall of the lower portion of the frame is shorter than the side wall of the upper portion. The frame is not rotational during operation of the engine and must be attached by mounting means (not shown) to a rigid support.

Crank 32 is journaled rotatably medially in the frame by means of upper bearing 34 and lower bearing 36. In the embodiment illustrated the crank comprises a short shaft having a length sufficient to allow its extension beyond the frame for mounting power transmission means, such as a flywheel or drive pulley 38. An oil pan 37 interconnects lower bearing 36 and a frame bearing 39 which is attached to the lower portion 24 of the frame.

In the embodiment illustrated the engine is shown for use in a four-stroke cycle wherein a first arcuate cylinder 40 and a second arcuate cylinder 42 having closed ends 43 are mounted rotatably to the crank by means of cylinder bearing 44. A planar connecting rod 46 interconnects the bearing and each of the cylinders and locates the cylinders oppositely one another in the frame. In the embodiment illustrated each cylinder defines a circular arc, shown in the preferred embodiment as being approximately 140°, and is fixed angularly relative to the other cylinder, either by the connecting rod or other appropriate means. The cylinders are illustrated as having rectangular cross sections for ease of machining in their fabrication. However, a circular or any other convenient cross section would serve as well.

A first piston 48 and a second piston 50 fit within the first and second cylinders, respectively. They are arcuate similarly to the cylinders and have rectangular cross sections configured for snug sliding fits within the cylinders. Compression rings (not shown) may be located at each end of the pistons to seal them further within the cylinders. The pistons are shorter than the cylinders, in the preferred embodiment having an arc of approximately 70°. Thus a chamber 51 is formed at each end of both cylinders. The difference between the arc of the pistons and the cylinders, along with the cross sectional area of the cylinders, determine the displacement of the engine.

The pistons are positioned for reciprocation within the cylinders by means of piston rods 52 which are connected freely through openings located medially in the inside peripheral surfaces of the pistons. Thus, when the piston rods thermally expand upon operation of the engine they will pass further into the openings and not displace the pistons relative to the cylinders. However, by forming a tight fit between each opening and the associated piston rod, piston motion will be transmitted without undue sloppiness. The other ends of the piston rods are joined rotatably to the crank by means of piston bearing 54. The piston bearing also carries the top portion of the oil pan 37. Piston slots 56 are located in the radially inner surfaces of the cylinder allowing passage of the piston rods therethrough. The length of the piston slots should be sufficient to permit the pistons to travel to both extremities of their cylinders.

Escapement means 60 transfers movement of the pistons and cylinders in a first direction, illustrated in the drawings as being clockwise, to the crank and prevents movement of the pistons and cylinders in the opposite, or counterclockwise, direction relative to the frame. In the first embodiment, best illustrated in FIG. 1, an outer ratchet ring 62 is attached to the frame to prevent the counterclockwise rotation. The ring has an outer diameter equal to the outside diameter of flanges 26 of the frame and is secured between the upper and lower portions of the frame by means of bolts 30. The inner periphery of the ring includes a plurality of ratchet teeth 64 configured to allow passage of a pawl in a clockwise direction therepast and to engage a pawl which is moving counterclockwise. The inner diameter of the outer ratchet ring is such that teeth 64 are located near the outer peripheral surfaces of cylinders 40 and 42.

An inner ratchet ring 66 is attached at its inner portion to crank 32. The outer portion of the ring includes a plurality of ratchet teeth 68 similar to the teeth 64 on the outer ring except that they are reversed. Thus the inner ratchet ring which is always moving in a clockwise direction, being fixed to the crank, will not engage pawls traveling in a clockwise direction at a slower speed. However, it will engage pawls trying to travel in a clockwise direction at a higher speed, thereby imparting torque to the crank. The outer diameter of the inner ratchet ring is such that the teeth 68 are located near the inner peripheral surfaces of the cylinders 40 and 42.

The outer and inner ratchet rings are coplanar with each other in respect to lateral displacement along the crank and are offset upwardly of piston rods 52 and downwardly of connecting rods 46 for convenience of fabrication.

Figure 3:
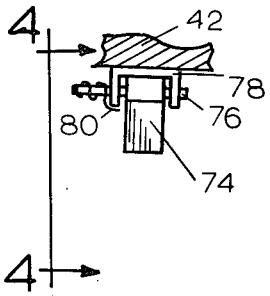
FIG. 3 is a cross sectional view taken on the line 3—3 of FIG. 1.
Figure 4:
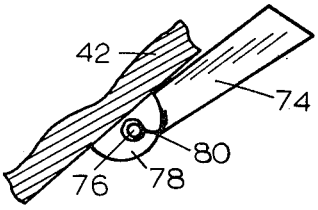
FIG. 4 is a cross sectional view taken on the line 4—4 of FIG. 3.

Inner cylinder pawls 70 and outer cylinder pawls 72 are located on the inner and outer peripheral surfaces respectively of the clockwise end portions of cylinders 40 and 42. Referring to FIGS. 3 and 4, they comprise pointed arms 74 which are joined pivotally by pins 76 to clevises 78 attached to the cylinders. Springs 80 normally urge the arms inwardly to retracted positions against the surfaces of the cylinders. The springs are weak enough, however, that upon rotary movement of the cylinders centrifugal force overcomes the springs and allows the arms to move outwardly to extended positions at an angle of approximately 45° to the cylinders.

The inner cylinder pawls 70 are joined to the cylinders in a manner such that the pointed portions of their arms face in the direction of clockwise cylinder travel. Thus when clockwise cylinder travel is initiated the pawls are urged inwardly against springs 80 to engage the inner ratchet ring 66 and drive the crank. The outer cylinder pawls 72 are joined to the cylinders in a manner such that the pointed portions of their arms face in the direction of counterclockwise cylinder travel. Thus when counterclockwise cylinder travel is initiated the pawls are urged outwardly against springs 80 to engage the outer ratchet ring 62 preventing further counterclockwise rotation of the cylinders.

Inner piston pawls 82 and outer piston pawls 84 are located on the inner and outer peripheral surfaces, respectively, of the pistons intermediate their ends. The piston pawls are constructed identically to the cylinder pawls. They pass freely through pawl slots 86 located on the inner and outer peripheral surfaces of the cylinders in order to contact the respective ratchet rings. The inner slot 86 could coincide with slot 56 if it is made wide enough.

The inner piston pawls 82 are joined to the pistons in a manner such that the pointed portions of their arms face in the direction of clockwise piston travel. Thus when clockwise piston travel is initiated the pawls are urged outwardly against springs 80 to engage the inner ratchet ring 66 and drive the crank clockwise. The outer piston pawls 84 are joined to the piston in a manner such that the pointed portions of their arms face in the direction of counterclockwise piston travel. Thus when counterclockwise piston travel is initiated, the pawls are urged outwardly against springs 80 to engage the outer ratchet ring 62 preventing further counterclockwise rotation of the piston.

A first alternate escapement means is shown in FIG. 12. In this embodiment an inner friction ring 138 and outer friction ring 140 replace the inner and outer ratchet rings, respectively. Movable friction plates 142 comprising rectangular pads 144 with high coefficient of friction outer surfaces each are joined pivotally to the cylinders and pistons by four legs 145. A spring (not shown) normally urges the pads inwardly to retracted positions against the cylinders or pistons. However, the springs are weak enough to be overcome by centrifugal force upon rotation of the elements allowing outwardly movement of the friction plates to extended positions in contact with the appropriate friction ring. The friction plates are oriented similarly to the pawls so that clockwise motion of either the pistons or cylinders is transmitted through the inner friction ring to the crank and counterclockwise rotation of the pistons or cylinders is prevented by the outer friction ring.

A second alternative escapement means is shown in FIG. 13. In this embodiment electromagnets 148 are attached at spaced intervals to the inner surface of the frame opposite the cylinders. The magnets are wound in parallel and are activated by an external power source 150. Each electromagnet normally has an open circuit which is closeable through joinder of inwardly facing contacts 152. Contacters 154 are located on the pistons and cylinders at predetermined spaced intervals relative to the electromagnets in a manner to contact the contacts periodically at certain relative rotational positions of rigidly mounted platens 156 relative to the electromagnets. Platens 156 are located on the outer surfaces of the pistons and cylinders at spaced intervals relative to the electromagnets in a manner such that the attraction between the platen and timely energized electromagnet causes the pistons and cylinders to be held against counterclockwise rotation relative to the frame. The gap between the platen and electromagnetic should be made as small as possible and the timing for electromagnet energization should be such that the magnet is energized when the platen approaches it and is de-energized once the platen is at its closest point to the magnet.

A similar set of electromagnets, platens and contacters is provided on the crank and inner surfaces of the pistons and cylinders to transfer clockwise rotation of the cylinders and pistons to the crank. These elements are not shown in order to simplify the drawings.

Valve means 88 located at each end of the cylinders comprise intake valves 90 and exhaust valves 92. The intake valves 90 are of the simple one-way check type, opening to allow intake of a fresh charge of air and fuel mixture from intake manifold 93 whenever the pressure in the respective chamber is less than that in the manifold, and closing to retain the mixture in the chamber during compression and firing. The exhaust valves 92, located on top of the cylinders are of the slide type, operable between open and closed positions by translation of slides 94.

The exhaust valves are activated by valve timing means, such as commutator ring 95 connected to the pistons by tabs 97 extending through tab slots 96 located in the upper surfaces of the cylinders. The tab slots have about the same arc length as the piston slots 56 and the pawl slots 86. In the embodiment illustrated paired nubs 98 depend from the ring on both sides of each exhaust valve for engagement with a stem 109 located on each slide 94 to actuate the slide.

Figure 5:
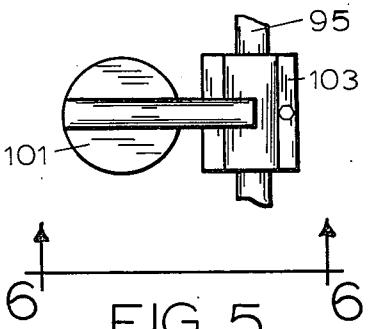
FIG. 5 is a fragmentary plan view taken on the line 5—5 of FIG. 1 and rotated 90°.
Figure 6:
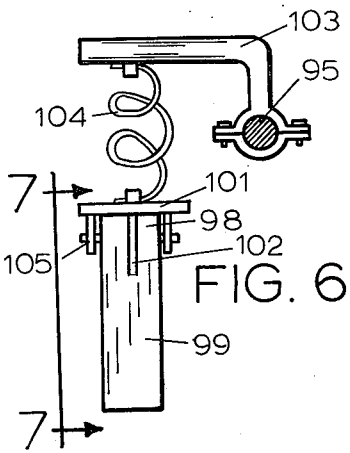
FIG. 6 is an end elevational view taken on line 6—6 of FIG. 5.
Figure 7:
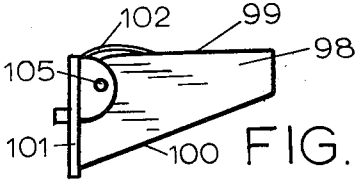
FIG. 7 is a fragmentary side elevational view taken on the line 7—7 of FIG. 6.

Referring to FIGS. 5, 6 and 7 each nub comprises a trapezoidal wedge having a flat contacting surface 99 and a sloped back surface 100. It is joined pivotally to platform 101 by means of hinge 105 and is urged to a position normal to the platform by a weak spring 102 which allows the nub to be easily deflected when its back surface 100 contacts stem 109. The platform is joined to a nub clamp 103 by means of a stiff spring 104. The nub clamp is releasably attached to ring 95. The spring 104 has sufficient side deflection resistance to allow the nub to move the slide when contacting surface 99 of the nub contacts stem 109 under normal conditions. However, in the event the slide is prevented from moving, the spring 104 will deflect allowing continued travel of the ring without damage to the nub or valve. The nubs are mounted in pairs on each side of each exhaust valve with their contacting surface 100 facing toward the valve.

Pneumatically operated relays 110 are attached to the top surfaces of the cylinders radially inwardly of each exhaust valve. They have extendable bifurcated prongs 112 which normally are located in a retracted position out of engagement with the slides. However, when one of the relays is activated by application of pneumatic pressure, the prong is extended to engage stem 109 of the adjacent slide, locking that valve in its closed position. A pressure switch 116 located at each of the ends of the cylinders is connected by tubing 117 to a relay 110 located at the next-to-fire chamber 51 to activate the relay to its extended position at the appropriate time in the engine operated sequence.

Ignition means (not shown) are provided at each chamber to ignite the air fuel mixture. A standard automative type capacitive discharge breaker point timing system may be used to provide short duration high voltage current from a coil to fire spark plugs. Timing may be provided by a timing ring such as that used for the exhaust valve timing. The type of ignition system per-se is not part of the present invention and has been omitted from the drawings in order to simplify the presentation.

In the embodiment illustrated fuel for the engine is stored in an annular fuel tank 118 which is joined at its inner portion to the crank by means of upper bearing 34 and cylinder bearing 44. The fuel tank rotates along with the cylinders to which it is tied by means of a fuel distribution line 119. The outer portion of the tank is joined to the frame by means of fuel tank bearing 120. A removable cap 122 is located on top of the tank allowing for the addition of fuel to the tank.

Fuel distribution means 124 provides a combustible mixture of air and fuel to the intake valves. Carburetor 126 located within a cylindrical enclosure 127 located in the fuel tank, combines atomized fuel with air passed through air filter 128 to a fuel distribution line 119, which in turn is joined to each of the intake valves through intake manifold 93.

Exhaust manifold 132 interconnects the exhaust valves with a muffler 134 located in the fuel tank in an enclosure 135 opposite to the enclosures 127 which house the carburetor. The exhaust then exits through exhaust pipe 136.

OPERATION

Having thus described my invention in preferred embodiments its operation may now be more fully understood. The four-stroke operating sequence of the engine is shown in FIGS. 8–11 wherein the chambers are numbered I, II, III, IV for convenience.

Figure 8:
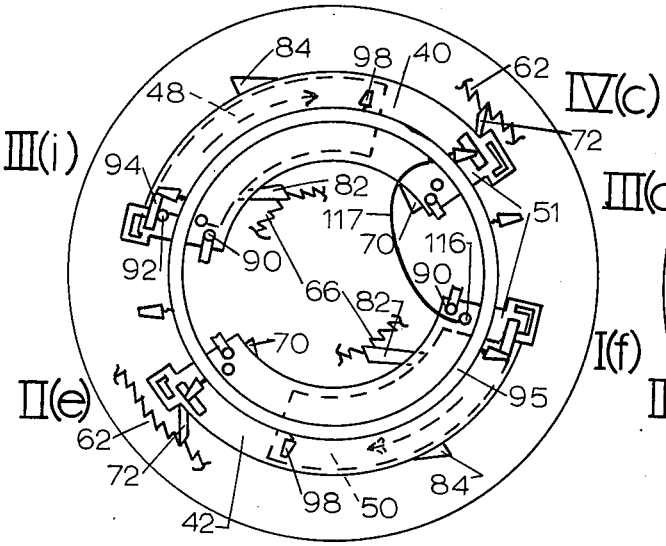
Figure 9:
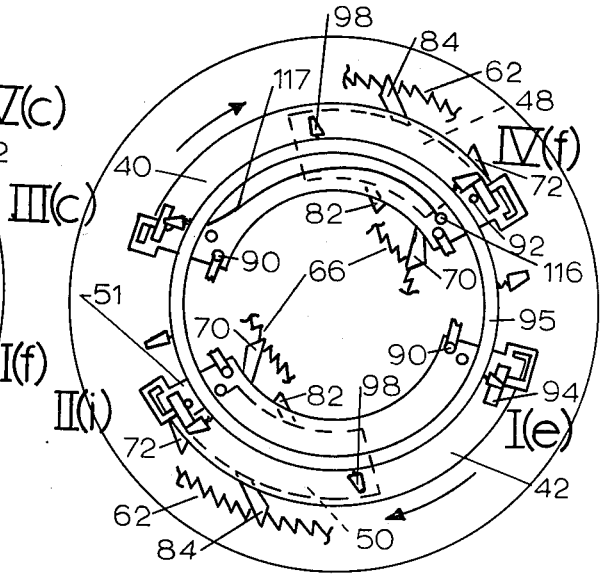
Figure 10:
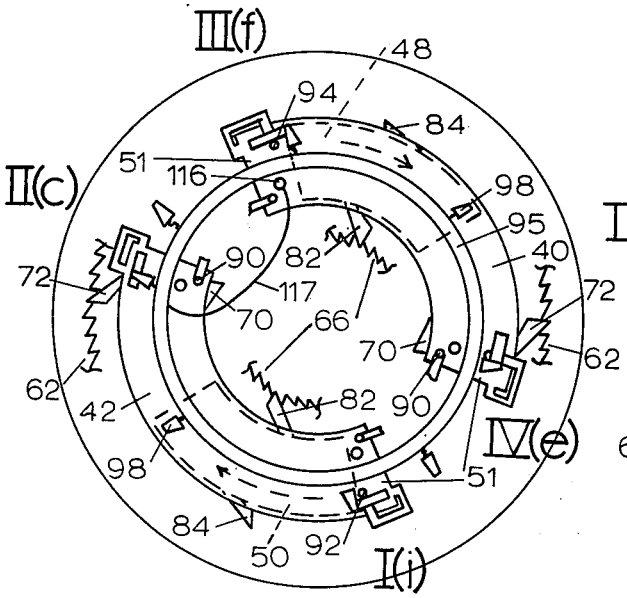
Figure 11:
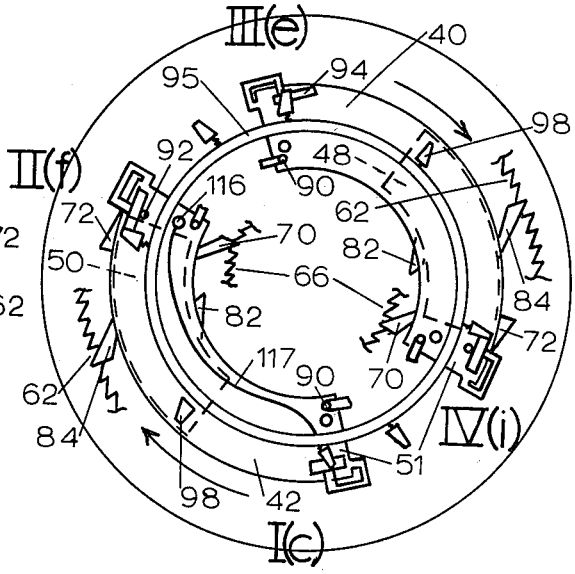

FIG. 8 shows the engine at completion of firing in chamber II. Chamber I contains a compressed charge of air and fuel, chamber II contains burned combustion gases to be exhausted, chamber III is empty for admission of a fresh charge of air and fuel, and chamber IV contains an uncompressed charge. At this point the pistons are located fully counterclockwise in their respective cylinders. Ring 95 which rotates with the pistons has four nubs 98 with counterclockwise facing contacting surfaces for contacting stem 109 upon counterclockwise rotation of the ring relative to the cylinders. They are positioned relative to the respective exhaust valves in such a manner that each nub 98 has contacted the stem 109 of slide 94 of the respective exhaust valve near the end of the firing stroke in chamber II. The effect was: in chamber I, to attempt to close the exhaust valve that already is in the closed position; in chamber II, to open the exhaust valve; in chamber III, to close the exhaust valve; and in chamber IV, to attempt unsuccessfully to open the exhaust valve. In chamber IV, although the nub 98 contacts the stem 109 of slide 94, it is unable to move the slide and open the valve because the pneumatically actuated prong 112 holds the stem 109 immovably. The prong is actuated by the relay 110 which is energized by the high pressure in chamber I.

During the stroke commencing from the position shown in FIG. 8, chamber I fires, chamber II exhausts, chamber III intakes a fresh charge and chamber IV compresses the charge located in it. As the charge in chamber I expands, it tends to drive the pistons clockwise and the cylinders counterclockwise. Centripetal force urges the inner piston pawls 82 inwardly into engagement with the inner ratchet ring imparting the clockwise piston rotation to the crank. The counterclockwise rotation of the cylinders causes the outer cylinder pawls to move outwardly into engagement with the outer ratchet ring thus preventing their further counterclockwise rotation. As a result the cylinders stay in the same position relative to the frame and the pistons are rotated fully clockwise with respect to the cylinders to the positions shown in FIG. 9.

The ring 95 moves with the pistons to a position relative to the cylinders where the clockwise facing nubs 98 close the exhaust valve at chamber II and open the exhaust valve at chamber I. The exhaust valve at chamber IV was closed and remains so. The raised pressure in chamber IV is transmitted to the pressure switch 116 associated therewith to activate the relay 110 associated with the exhaust valve at chamber III locking the valve in its closed position and deflecting the nub on spring 104. The exhaust valve at chamber III would otherwise have been opened.

In the second stroke chamber IV fires, chamber I exhausts, chamber II intakes a fresh charge and chamber III compresses the charge located in it. Upon firing of chamber IV the resulting expansion tends to drive the pistons counterclockwise and the cylinders clockwise. Centrifugal force resulting from the counterclockwise rotation of the pistons urges the outer piston pawls 84 outwardly into engagement with the outer ratchet ring preventing further counterclockwise piston rotation. The clockwise rotation of the cylinders urges the inner cylinder pawls 70 inwardly engaging the inner ratchet ring to continue clockwise rotation of the crank. As a result, the pistons remain in the same position relative to the frame and the cylinders are rotated clockwise to the position shown in FIG. 10.

Upon cylinder travel the ring 95 moves relative to the cylinders to a position where the counterclockwise facing nubs 98 close the exhaust valve at chamber I and open the exhaust valve at chamber IV. The exhaust valve at chamber III remains in its closed position. The raised pressure in chamber III is transmitted to the pressure switch 116 associated therewith to actuate the relay 110 associated with the exhaust valve at chamber II locking the valve in its closed position and deflecting the nub on spring 104. The exhaust valve at chamber III would otherwise have been opened.

In the third stroke chamber III fires, chamber IV exhausts, chamber I intakes a fresh charge, and chamber II compresses the charge in it. Upon firing of chamber III the resulting expansion tends to drive the pistons clockwise and the cylinders counterclockwise. Centrifugal force resulting from the counterclockwise rotation of the cylinders urges the outer cylinder pawls outwardly into engagement with the outer ratchet rings preventing further counterclockwise cylinder rotation. The clockwise rotation of the pistons urges the inner piston pawls inwardly engaging the inner ratchet ring continuing clockwise rotation of the crank. As a result, the cylinders remain in the same position relative to the frame and the pistons are rotated clockwise to the position shown in FIG. 11.

The ring 95 moves with the pistons to a position relative to the cylinder where the clockwise facing nubs 98 close the exhaust valve at chamber IV and open the exhaust valve at chamber III. The exhaust valve at chamber II remains closed. The raised pressure in chamber II is transmitted to the pressure switch 116 associated therewith to activate the relay 110 associated with the exhaust valve at chamber I locking the exhaust valve in its closed position and deflecting the nub on spring 104. Otherwise the exhaust valve at chamber I would have been opened.

In the fourth stroke, chamber II fires, chamber III exhausts, chamber IV intakes a fresh charge, and chamber I compresses the charge in it. Upon firing of chamber II the resulting expansion tends to drive the cylinders clockwise and the pistons counterclockwise. Centrifugal force resulting from the counterclockwise rotation of the pistons urges the outer piston pawls outwardly into engagement with the outer ratchet ring preventing further piston counterclockwise rotation. The clockwise rotation of the cylinders urges the inner cylinder pawls inwardly engaging the inner ratchet ring to continue clockwise rotation of the crank. As a result, the pistons remain in the same position relative to the frame and the cylinders are rotated clockwise to the relative position shown in FIG. 8. Thus a full cycle has been completed and the engine is in a position to repeat its cycle. It will be noted that only two cylinders are shown in the preferred embodiment. This is the minimum number for the four-stroke cycle operation described. However, additional sets of two could be attached to the crank in a like manner to provide a larger engine.

It will be noted also that the basic concept of the engine is not limited to the four-stroke cycle. The invention may easily be adapted by changing the valve means, timing means and ignition means to operate on a stirling cycle or as a steam engine. In addition a single cylinder and piston may be utilized for two stroke cycle operation.

The operation of alternate escapement means is obvious from their description, and provides results similar to the above. Detailed description of their operations would do little except legthen the specification and so are omitted.

Operational details of the engine, such as starting means, lubrication means and an ignition system have not been included for simplicity of presentation. Conventional systems known in the prior art can readily be adapted to the particular requirements of the present engine to serve these functions.

Having thus described my invention in perferred embodiments, what I claim is:

1. A rotary engine comprising:

a. a non-rotatable frame, b. a crank rotatably journaled centrally in the frame, c. at least one annular cylinder having closed end portions and a connecting rod, the connecting rod interconnecting the cylinder and the crank for free orbital rotation of the cylinder about the crank and configured to position the cylinder within the frame, d. at least one annular piston and a piston rod, the piston rod interconnecting the piston and the crank for free orbital rotation of the piston about the crank and configured to position the piston within the cylinder for reciprocating movement therebetween, wherein e. the cylinder defines an arc of greater extent than the piston forming a combustion chamber at each end thereof, and f. escapement means configured to automatically, selectively, intermittently interengage the piston and cylinder with the frame and crank in a manner to transfer orbital rotation of the piston and cylinder in a first direction to the crank and prevent orbital rotation of the piston and cylinder in the opposite direction relative to the frame.

2. The invention of claim 1 wherein the escapement means comprises:

a. an outer ratchet ring fixably attached to the frame and having inwardly facing teeth, b. an inner ratchet ring fixably attached to the crank for rotation therewith and having outwardly facing teeth, c. an outer piston pawl and an outer cylinder pawl pivotally attached to the outer peripheral surfaces of the piston and cylinder, respectively, each configured for engagement with the outer ratchet ring when counterclockwise rotation of the piston or cylinder is initiated preventing further counterclockwise rotation of the piston or cylinder and for disengagement with the outer ratchet ring when clockwise rotation of the piston or cylinder is initiated, and d. an inner piston pawl and an inner cylinder pawl pivotally attached to the inner peripheral surfaces of the piston and cylinder, respectively, each configured for engagement with the inner ratchet ring when clockwise rotation of the piston or cylinder is initiated transferring the clockwise rotation of the piston or cylinder to the crank, and for disengagement with the inner ratchet ring when counterclockwise rotation of the piston or cylinder with respect to the crank is initiated.

3. In a rotary internal combustion engine having valve means, valve timing means, fuel distribution means and ignition means configured for operation on a four-stroke cycle with a combustible mixture of fuel and air, a propulsion system comprising:

a. a non-rotatable frame, b. a crank rotatably journaled centrally in the frame, c. at least two annular cylinders having closed end portions, and at least one connecting rod; the connecting rod interconnecting the cylinders and the crank for free orbital rotation of the cylinders about the crank and configured to position the cylinders within the frame, d. at least two annular pistons and at least one piston rod; the piston rod interconnecting the pistons and the crank for free orbital rotation of the pistons about the crank and configured to position the pistons within the cylinders for reciprocating movement therebetween, wherein e. the cylinders define arcs of greater extent than the pistons forming combustion chambers at each end, and f. escapement means configured to automatically, selectively, intermittently interengage the pistons and cylinders with the frame and crank in a manner to transfer orbital rotation of the pistons and cylinders in a first direction to the crank and prevent rotation of the pistons and cylinders in the opposite direction relative to the frame.

4. The invention of claim 3 wherein the valve means comprises:

a. intake valves, located in the cylinders adjacent each chamber, said intake valves being the one-way check valve type allowing intake of the fuel and air mixture whenever chamber pressure is less than that of the mixture at the valves and preventing release of the mixture whenever chamber pressure is greater than that of the mixture at the valves, b. exhaust valves, located in the cylinders adjacent each chamber, and slides associated with each valve for movement of the valves between open and closed positions, and c. the valve timing means operably engages the slides in a manner to close all the exhaust valves except the one located in the chamber currently in the exhaust stroke of the engine cycle.

5. The invention of claim 4 wherein the timing means comprises:

a. a commutator ring attached to the piston for orbital rotation therewith, b. nubs attached to the commutator ring and configured to engage the slides of the exhaust valves selectively in a manner to move the exhaust valves between their open and closed positions depending on the angular position of the ring relative to the cylinders, c. means to allow deflection of the nubs in the event the slides are prevented from moving when engaged by the nubs, and d. locking means, associated with each exhaust valve, configured to lock the exhaust valve in its closed position upon sensing a raised pressure in a preselected other chamber.

6. The invention of claim 3 wherein the escapement means comprises:

a. an outer ratchet ring having inwardly facing teeth and fixably attached to the frame, b. an inner ratchet ring having outwardly facing teeth and fixably attached to the crank for rotation therewith, c. an outer piston pawl and an outer cylinder pawl pivotally attached to the radially outer surfaces of the pistons and cylinders, respectively, and each configured for engagement with the outer ratchet ring when counterclockwise rotation of the pistons or cylinders is initiated to prevent further counterclockwise rotation of the pistons or cylinders and for disengagement with the outer ratchet ring when clockwise rotation of the pistons or cylinders is initiated, and d. an inner piston pawl and an inner cylinder pawl pivotally attached to the radially inner surfaces of the pistons and cylinders, respectively, and each configured for engagement with the inner ratchet ring when clockwise rotation of the pistons or cylinders is initiated to transfer the clockwise rotation of the pistons or cylinders to the crank and for disengagement with the inner ratchet ring when counterclockwise rotation of the pistons or cylinders is initiated.

7. The invention of claim 3 wherein the escapement means comprises:

a. an outer friction ring fixably attached to the frame and having an inwardly facing friction surface, b. an inner friction ring fixably attached to the crank for rotation therewith and having an outwardly facing friction surface, c. at least one outer piston friction plate and at least one outer cylinder friction plate pivotally attached to the outer peripheral surfaces of the piston and cylinders, respectively, having pads with friction surfaces thereon, and configured for engagement with the outer friction ring when counterclockwise rotation of the pistons or cylinders is initiated preventing further counterclockwise rotation of the pistons or cylinders and for disengagement with the outer friction ring when clockwise rotation of the pistons or cylinders is initiated, and d. at least one inner piston friction plate and at least one inner cylinder friction plate pivotally attached to the inner peripheral surfaces of the pistons and cylinders, respectively, having pads with friction surfaces, and configured for engagement with the inner friction ring when clockwise rotation of the pistons or cylinders is initiated transmitting the clockwise rotation of the pistons or cylinders to the crank and for disengagement with the inner friction rings when counterclockwise rotation of the pistons or cylinders with respect to the crank is initiated.

8. The invention of claim 3 wherein escapement means comprises:

a. at least a plurality of electromagnets located at spaced intervals on the inner peripheral portion of the frame, b. paired contacts extending inwardly from each first electromagnet, c. the first electromagnets being activated only when their associated pairs of contacts are interconnected, d. at least a plurality of contacters located on the outer surfaces of the pistons and the cylinders at selected spaced intervals relative to the first electromagnets and each positioned to engage and interconnect an associated pair of contacts when in alignment therewith to activate the associated first electromagnets, e. at least a plurality of first platens located on the outer surfaces of the pistons and cylinders closely separated from the first electromagnets at selected spaced intervals relative to the first electromagnets and positioned within the magnetic field of the first electromagnets, f. said first electromagnets, first contacters and first platens being radially positioned relative to one another in such a manner that the first contacters engage their associated pairs of contacts of the first electromagnets activating the first electromagnets when the first platens approach them and de-activate the first electromagnets when the first platens become adjacent to them so that the magnetic fields of the first electromagnets act on the first platens in a manner preventing counterclockwise rotation of the pistons and cylinders relative to the frame, g. at least a plurality of second electromagnets located at spaced intervals on the outer periphery of the crank, h. paired contacts extending outwardly from each second electromagnet, i. the second electromagnets being activated only when their associated pairs of contacts are interconnected, j. at least a plurality of second contacters located on the inner surfaces of the pistons and cylinders at selected spaced intervals relative to the second electromagnets and each positioned to engage and interconnect an associated pair of contacts when in alignment therewith to activate the second electromagnets, k. at least a plurality of second platens located on the inner surfaces of the pistons and cylinders closely separated from the second electromagnets at selected spaced intervals relative to the second electromagnets and positioned within the magnetic field of the second electromagnets, and l. said second electromagnets, second contacters and second platens being radially positioned relative to each other in such a manner that the second contacters engage their associated pairs of contacts of the second electromagnets activating the second electromagnets when the second platens approach them and de-activate the second electromagnets when the second platens become adjacent to them so that the magnetic fields of the second electromagnets act on the second platens in a manner that clockwise rotation of the pistons and cylinders is imparted to the crank.

* * * * *